US009327167B2

(12) United States Patent
Raynak et al.

(10) Patent No.: US 9,327,167 B2
(45) **Date of Patent: *May 3, 2016**

(54) SPORT BALL CASING AND METHODS OF MANUFACTURING THE CASING

(71) Applicant: Nike, Inc., Beaverton, OR (US)

(72) Inventors: Geoffrey C. Raynak, Portland, OR (US); Vincent F. White, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 189 days.

This patent is subject to a terminal disclaimer.

(21) Appl. No.: 14/030,226

(22) Filed: Sep. 18, 2013

(65) Prior Publication Data

US 2014/0087899 A1 Mar. 27, 2014

Related U.S. Application Data

(63) Continuation of application No. 12/408,322, filed on Mar. 20, 2009, now Pat. No. 8,608,599.

(51) Int. Cl.

| | |
|---|---|
| ***A63B 41/10*** | (2006.01) |
| ***A63B 41/08*** | (2006.01) |
| ***A63B 45/00*** | (2006.01) |

(52) U.S. Cl.

CPC ..... *A63B 41/10* (2013.01); *A63B 41/08* (2013.01); *A63B 45/00* (2013.01); *A63B 2209/00* (2013.01); *A63B 2243/0025* (2013.01); *Y10T 156/10* (2015.01); *Y10T 156/108* (2015.01)

(58) Field of Classification Search

CPC ..... A63B 45/00; A63B 41/10; A63B 41/08; A63B 2209/00; A63B 2243/0025

USPC ..... 473/599, 603–605, 607, 608

See application file for complete search history.

(56) References Cited

U.S. PATENT DOCUMENTS

| | | | |
|---|---|---|---|
| 414,748 | A | 11/1889 | Bentley |
| 1,187,029 | A | 6/1916 | Beebout |
| 1,517,859 | A | 12/1924 | O'Shea |
| 1,575,281 | A | 3/1926 | Rosenberg |

(Continued)

FOREIGN PATENT DOCUMENTS

| | | | |
|---|---|---|---|
| BE | 535426 | A | 2/1955 |
| CN | 102076386 | A | 5/2011 |

(Continued)

OTHER PUBLICATIONS

Response filed Aug. 6, 2014 in European Patent Application No. 10712595.7.

(Continued)

*Primary Examiner* — Steven Wong

(74) *Attorney, Agent, or Firm* — Quinn Law Group, PLLC

(57) ABSTRACT

A sport ball may include a casing and a bladder located within the casing. The casing may include a plurality of panel elements joined to each other with welds, and portions of the panel elements that include the welds may project toward an interior of the ball. A method of manufacturing a sport ball may include providing a plurality of casing elements that include a thermoplastic polymer material. Edges of the casing elements are welded to each other to join the casing elements. The casing elements may then be turned inside-out through an aperture formed by at least one of the casing elements, and the aperture may be sealed.

19 Claims, 17 Drawing Sheets

(56) References Cited

U.S. PATENT DOCUMENTS

| | | | |
|---|---|---|---|
| 1,890,566 | A | 12/1932 | Bartky |
| 1,917,535 | A | 7/1933 | Maynard |
| 1,923,236 | A | 8/1933 | Sonnett |
| 1,932,226 | A | 10/1933 | Pierce |
| 1,967,908 | A | 7/1934 | Sneary |
| 2,012,376 | A | 8/1935 | Caro |
| 2,018,559 | A | 10/1935 | Horner |
| 2,080,894 | A | 5/1937 | Levinson |
| 2,126,220 | A | 8/1938 | Scudder |
| 2,221,534 | A | 11/1940 | Voit et al. |
| 2,300,441 | A | 11/1942 | Voit et al. |
| 2,325,073 | A | 7/1943 | Reach |
| 2,344,638 | A | 3/1944 | Reeder |
| 2,945,693 | A | 7/1960 | Way |
| 3,119,618 | A | 1/1964 | Molitor et al. |
| 3,219,347 | A | 11/1965 | Way |
| 3,512,777 | A | 5/1970 | Henderson |
| 4,154,789 | A | 5/1979 | Delacoste |
| D264,365 | S | 5/1982 | Arino |
| 4,354,679 | A | 10/1982 | Steinmetz |
| 4,436,276 | A | 3/1984 | Donahue |
| 4,462,590 | A | 7/1984 | Mitchell |
| 4,542,902 | A | 9/1985 | Massino |
| 4,610,071 | A | 9/1986 | Miller |
| 4,660,831 | A | 4/1987 | Kralik |
| 4,796,888 | A | 1/1989 | Louez |
| 4,856,781 | A | 8/1989 | Shishido et al. |
| D322,105 | S | 12/1991 | Ma |
| 5,123,659 | A | 6/1992 | Williams |
| 5,181,717 | A | 1/1993 | Donntag et al. |
| 5,250,070 | A | 10/1993 | Parodi |
| 5,253,799 | A | 10/1993 | Sebesta |
| 5,494,625 | A | 2/1996 | Hu |
| 5,503,699 | A | 4/1996 | Ratner et al. |
| 5,603,497 | A | 2/1997 | Louez |
| 5,752,890 | A | 5/1998 | Shishido et al. |
| 5,772,545 | A | 6/1998 | Ou |
| 5,888,157 | A | 3/1999 | Guenther et al. |
| 6,012,997 | A | 1/2000 | Mason |
| 6,142,897 | A | 11/2000 | Lees |
| 6,206,794 | B1 | 3/2001 | Chan |
| 6,261,400 | B1 | 7/2001 | Kennedy, III |
| 6,302,815 | B1 | 10/2001 | Shishido et al. |
| 6,331,151 | B2 | 12/2001 | Calandro |
| 6,461,461 | B2 | 10/2002 | Kennedy, III |
| 6,503,162 | B1 | 1/2003 | Shishido et al. |
| 6,629,902 | B2 | 10/2003 | Murphy et al. |
| 6,645,099 | B2 | 11/2003 | Gaff et al. |
| 6,685,585 | B2 | 2/2004 | Shishido et al. |
| 6,726,582 | B1 | 4/2004 | Kuo et al. |
| 6,726,583 | B1 | 4/2004 | Lai |
| 6,971,965 | B1 | 12/2005 | Shishido |
| 6,991,569 | B2 | 1/2006 | Dobrounig |
| 7,005,025 | B2 | 2/2006 | Summers |
| 7,018,311 | B2 | 3/2006 | Ou |
| 7,029,407 | B2 | 4/2006 | Lee et al. |
| 7,066,853 | B2 | 6/2006 | Chang |
| 2,073,766 | A1 | 10/2008 | Suzuki |
| 7,740,782 | B2 | 6/2010 | Ou |
| 7,749,116 | B2 | 7/2010 | Tang et al. |
| 7,753,813 | B2 | 7/2010 | Taniguchi et al. |
| 8,262,519 | B2 | 9/2012 | Raynak et al. |
| 8,602,927 | B2 | 12/2013 | Marc |
| 8,608,599 | B2 | 12/2013 | Raynak et al. |
| 2001/0002378 | A1 | 5/2001 | Calandro |
| 2002/0086749 | A1 | 7/2002 | Ou |
| 2003/0073527 | A1 | 4/2003 | Ou Chen |
| 2003/0203780 | A1 | 10/2003 | Guenther et al. |
| 2004/0077288 | A1 | 4/2004 | Krysiak et al. |
| 2004/0087396 | A1 | 5/2004 | Chan |
| 2004/0144477 | A1 | 7/2004 | Taniguchi et al. |
| 2004/0229722 | A1 | 11/2004 | Liu |
| 2005/0081982 | A1 | 4/2005 | Chen |
| 2005/0229985 | A1 | 10/2005 | Saxenfelt |
| 2006/0063622 | A1 | 3/2006 | Nurnberg et al. |
| 2006/0229149 | A1 | 10/2006 | Goedoen |
| 2006/0229150 | A1 | 10/2006 | Ou |
| 2006/0293132 | A1 | 12/2006 | Laliberty et al. |
| 2007/0049434 | A1 | 3/2007 | Maziarz et al. |
| 2007/0082768 | A1 | 4/2007 | Chen |
| 2007/0129188 | A1 | 6/2007 | Maziarz et al. |
| 2007/0225094 | A1 | 9/2007 | Nix |
| 2008/0139349 | A1 | 6/2008 | Ou |
| 2009/0005199 | A1 | 1/2009 | Taniguchi et al. |
| 2009/0011878 | A1 | 1/2009 | Ou |
| 2009/0082144 | A1 | 3/2009 | Pacheco |
| 2009/0105019 | A1 | 4/2009 | Keppler et al. |
| 2009/0209374 | A1 | 8/2009 | Ou |
| 2009/0325744 | A1 | 12/2009 | Raynak et al. |
| 2009/0325745 | A1 | 12/2009 | Rapaport et al. |
| 2010/0167850 | A1 | 7/2010 | Lin |
| 2010/0240479 | A1 | 9/2010 | Raynak et al. |
| 2011/0124448 | A1 | 5/2011 | Ou |
| 2011/0177895 | A1 | 7/2011 | Lin |
| 2011/0220279 | A1 | 9/2011 | Raynak et al. |
| 2012/0142465 | A1 | 6/2012 | Berggren et al. |
| 2012/0172160 | A1 | 7/2012 | Marc |
| 2012/0277044 | A1 | 11/2012 | Berggren et al. |
| 2012/0329587 | A1 | 12/2012 | Ou |
| 2013/0053193 | A1 | 2/2013 | Lo |

FOREIGN PATENT DOCUMENTS

| | | | |
|---|---|---|---|
| DE | 1 169 820 | B | 5/1964 |
| DE | 19624020 | C1 | 5/1997 |
| DE | 197 04 778 | A1 | 11/1997 |
| DE | 10 2004 056 951 | A1 | 6/2006 |
| EP | 0 598 542 | A2 | 5/1994 |
| FR | 2 572 674 | A1 | 5/1986 |
| GB | 2 201 281 | A | 8/1988 |
| GB | 2 412 911 | A | 10/2005 |
| JP | 53-108533 | A | 9/1978 |
| JP | 10-217041 | A | 8/1998 |
| JP | 10-337341 | A | 12/1998 |
| JP | 2005-081604 | A | 3/2005 |
| JP | 2005-340505 | A | 12/2005 |
| JP | 2008-506429 | A | 3/2008 |
| WO | 2004/056424 | A1 | 7/2004 |
| WO | 2009158103 | A1 | 12/2009 |
| WO | 2010/107553 | A1 | 9/2010 |
| WO | 2010133305 | A1 | 11/2010 |
| WO | 2013/148946 | A1 | 10/2013 |

OTHER PUBLICATIONS

Amended claims filed Jul. 25, 2014 in European Patent Application No. 13723276.5.

Final Office Action mailed Jul. 21, 2014 in U.S. Appl. No. 13/434,890.

Notice of Allowance mailed Oct. 27, 2014 in U.S. Appl. No. 13/434,890.

Request for Reexamination filed Dec. 17, 2014 in Chinese Patent Application No. 201080012013.0.

International Search Report and Written Opinion mailed Jul. 2, 2010 in PCT Application No. PCT/US2010/024898.

International Search Report and Written Opinion mailed Jul. 4, 2013 in in PCT Application No. PCT/US2013/034268.

Office Action dated May 13, 2013 in Chinese Patent Application No. 201080012013.0.

Office Action dated Jun. 13, 2013 in Japanese Patent Application No. 2012-500812.

Office Action dated Feb. 8, 2012 in U.S. Appl. No. 13/116,651.

Amendment filed May 8, 2012 in U.S. Appl. No. 13/116,651.

Notice of Allowance dated May 16, 2012 in U.S. Appl. No. 13/116,651.

Office Action dated Jun. 30, 2011 in U.S. Appl. No. 12/408,322.

Amendment filed Oct. 26, 2011 in U.S. Appl. No. 12/408,322.

Final Office Action dated Dec. 28, 2011 in U.S. Appl. No. 12/408,322.

Amendment filed Jan. 24, 2012 in U.S. Appl. No. 12/408,322.

Office Action dated Jan. 7, 2013 in U.S. Appl. No. 12/408,322.

(56) References Cited

OTHER PUBLICATIONS

Amendment filed Apr. 8, 2013 in U.S. Appl. No. 12/408,322.
Final Office Action dated May 30, 2013 in U.S. Appl. No. 12/408,322.
Advisory Action dated Aug. 6, 2013 in U.S. Appl. No. 12/408,322.
Interview Summary dated Aug. 6, 2013 in U.S. Appl. No. 12/408,322 (date of Interview Aug. 5, 2013).
Interview Summary dated Aug. 16, 2013 in U.S. Appl. No. 12/408,322 (date of Interview Aug. 14, 2013).
Response to Office Action filed Sep. 11, 2013 in Japanese Patent Application No. 2012-500812.
Response to Office Action filed Oct. 28, 2013 in Chinese Patent Application No. 201080012013.0.
Office Action dated Mar. 10, 2014 in U.S. Appl. No. 13/434,890.
Office Action dated Nov. 29, 2013 in U.S. Appl. No. 13/434,890.
Amendment filed Dec. 30, 2013 in U.S. Appl. No. 13/434,890.
Office Action dated Feb. 17, 2014 in Chinese Patent Application No. 201080012013.0.
Response to Office Action filed May 4, 2014 in Chinese Patent Application No. 201080012013.0.
Office Action dated Apr. 9, 2014 in European Patent Application No. 10712595.7.
Final Office Action dated May 22, 2014 in Japanese Patent Application No. 2012-500812.
Amendment filed Jun. 10, 2014 in U.S. Appl. No. 13/434,890.
Decision of Rejection issued Sep. 2, 2014 in Chinese Patent Application No. 201080012013.0.
Amendment after Final filed Oct. 17, 2014 in U.S. Appl. No. 13/434,890.
Response to Office Action filed Sep. 19, 2014 in Japanese Patent Application No. 2012-500812.
International Preliminary Report on Patentability (including Written Opinion of the ISA) mailed Oct. 9, 2014 in PCT/US2013/034268.

SPORT BALL CASING AND METHODS OF MANUFACTURING THE CASING

CROSS-REFERENCE TO RELATED APPLICATION

This application is a continuation of Raynak et al., U.S. Patent Application Publication No. 2010/0240479, published on Sep. 23, 2010, entitled "Sport Ball Casing and Methods of Manufacturing the Casing," the entire disclosure of which is incorporated herein by reference.

BACKGROUND

A variety of inflatable sport balls, such as a soccer ball, conventionally exhibit a layered structure that includes a casing, an intermediate layer, and a bladder. The casing forms an exterior portion of the sport ball and is generally formed from a plurality of durable and wear-resistant panels joined together along abutting edges (e.g., with stitching or adhesives). Although panel configurations may vary significantly, the casing of a traditional soccer ball includes thirty-two panels, twelve of which have a pentagonal shape and twenty of which have a hexagonal shape.

The intermediate layer forms a middle portion of the sport ball and is positioned between the casing and the bladder. Among other purposes, the intermediate layer may provide a softened feel to the sport ball, impart energy return, and restrict expansion of the bladder. In some configurations, the intermediate layer or portions of the intermediate layer may be bonded, joined, or otherwise incorporated into the casing as a backing material.

The bladder, which has an inflatable configuration, is located within the intermediate layer to provide an interior portion of the sport ball. In order to facilitate inflation (i.e., with pressurized air), the bladder generally includes a valved opening that extends through each of the intermediate layer and casing, thereby being accessible from an exterior of the sport ball.

SUMMARY

A sport ball may include a casing and a bladder located within the casing. The casing may include a plurality of panel elements joined to each other with welds, and portions of the panel elements that include the welds may project toward an interior of the ball.

A method of manufacturing a sport ball may include providing a plurality of casing elements that include a polymer material, which may be a thermoplastic polymer material. Edges of the casing elements are welded to each other to join the casing elements. The casing elements may then be turned inside-out through an aperture formed by at least one of the casing elements, and the aperture may be sealed.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose various sport ball configurations and methods relating to manufacturing of the sport balls. Although the sport ball is discussed and depicted in relation to a soccer ball, concepts associated with the configurations and methods may be applied to various types of inflatable sport balls. In addition to soccer balls, therefore, concepts discussed herein may be incorporated into basketballs, footballs (for either American football or rugby), volleyballs, and water polo balls, for example. A variety of non-inflatable sport balls, such as baseballs and softballs, may also incorporate concepts discussed herein.

Figure 1:
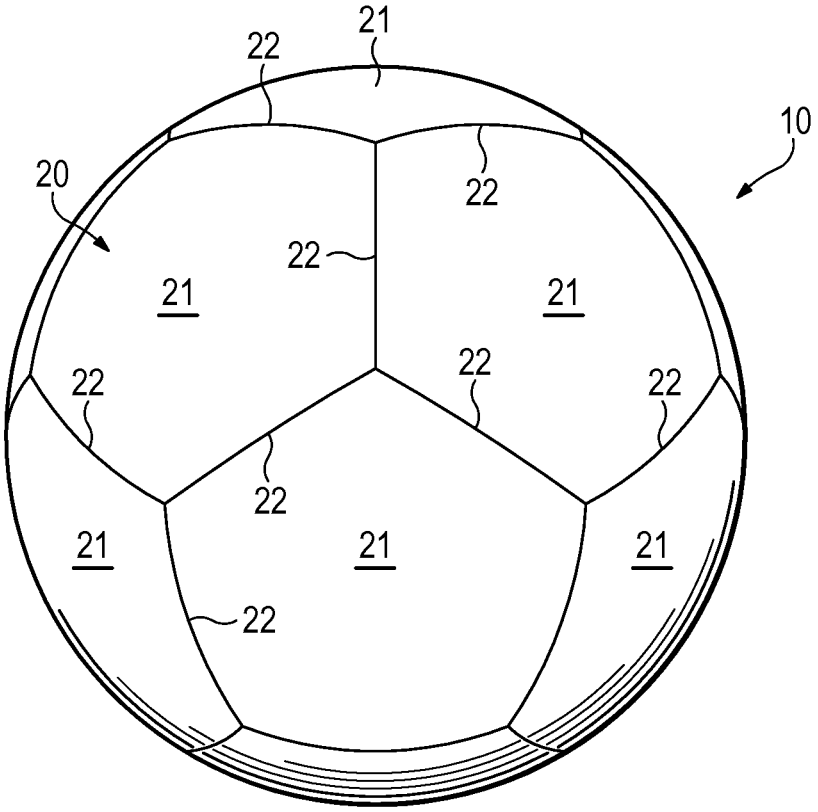
FIG. 1 is a perspective view of a sport ball.
Figure 2:
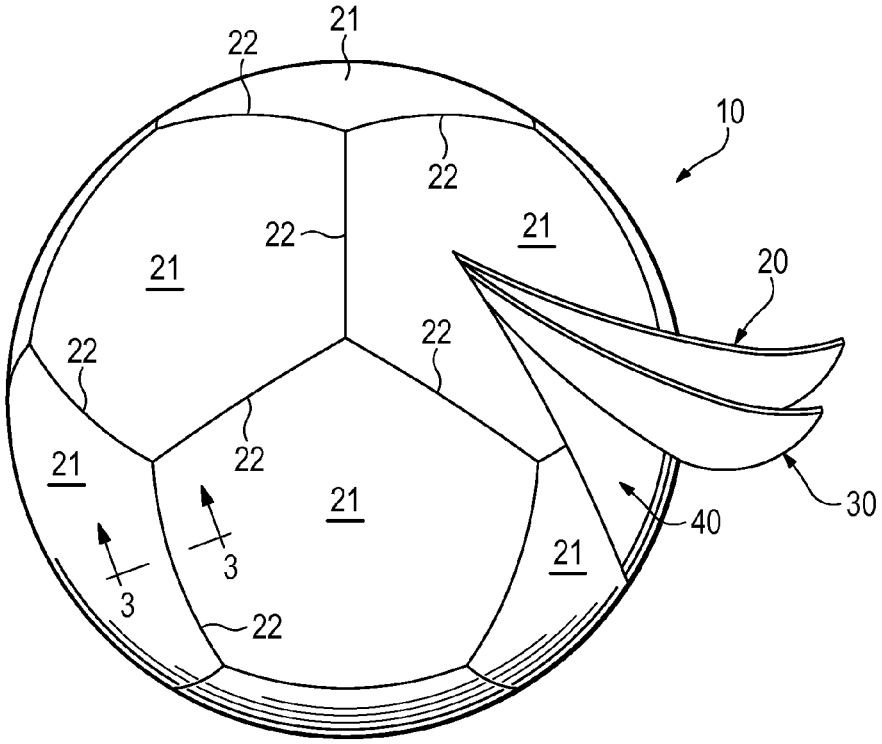
FIG. 2 is another perspective view of the sport ball.
Figure 3:
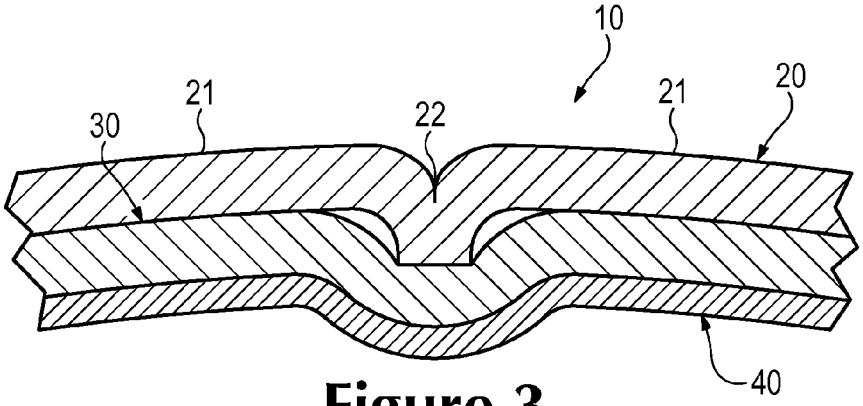
FIG. 3 is a cross-sectional view of a portion of the sport ball, as defined by section line 3-3 in FIG. 2.

A sport ball 10 having the general configuration of a soccer ball is depicted in FIGS. 1-3. Ball 10 exhibits a layered structure having (a) a casing 20 that forms an exterior portion of ball 10, (b) an intermediate layer 30 located within casing 20, and (c) an inflatable bladder 40 that forms an interior portion of ball 10. Upon pressurization, bladder 40 induces ball 10 to take on a substantially spherical shape. More particularly, pressure within bladder 40 causes bladder 40 to place an outward force upon intermediate layer 30. In turn, intermediate layer 30 places an outward force upon casing 20. In order to limit expansion of bladder 40 and also limit tension in casing 20, a portion of intermediate layer 30 may have a limited degree of stretch. In other words, bladder 40 places an outward force upon intermediate layer 30, but the stretch characteristics of intermediate layer 30 effectively prevent the outward force from inducing significant tension in casing 20. Accordingly, intermediate layer 30 restrains pressure from bladder 40, while permitting outward forces to induce a spherical shape in casing 20, thereby imparting a spherical shape to ball 10.

Casing 20 is formed from various panels 21 that are joined together along abutting sides or edges to form a plurality of seams 22. Although panels 21 are depicted as having the shapes of twelve equilateral pentagons, panels 21 may have non-equilateral shapes, concave or convex edges, or a variety of other shapes (e.g., triangular, square, rectangular, hexagonal, trapezoidal, round, oval, non-geometrical) that combine in a tessellation-type manner to form casing 20. In some configurations, ball 10 may have twelve pentagonal panels 21 and twenty hexagonal panels 21 to impart the general configuration of a traditional soccer ball. Selected panels 21 may also be formed of unitary (i.e., one piece) construction with adjacent panels 21 to form bridged panels that reduce the number of seams 22. Accordingly, the configuration of casing 20 may vary significantly.

A distinction between conventional casings and casing 20 relates to the manner in which panels 21 are joined to form seams 22. The panels of conventional sport balls may be joined with stitching (e.g., hand or machine stitching). In contrast, a welding process is utilized in the manufacture of ball 10 to join panels 21 and form seams 22. More particularly, panels 21 are at least partially formed from a polymer material, which may be a thermoplastic polymer material, and edges of panels 21 may be heated and bonded to each other to form seams 22.

An example of the configuration of seams 22 is depicted in the cross-section of FIG. 3, wherein the welding process has effectively secured, bonded, or otherwise joined two of panels 21 to each other by combining or intermingling the polymer material from each of panels 21. In some configurations, some of panels 21 may be joined through stitching or various seams 22 may be supplemented with stitching.

One advantage of utilizing a welding process to form seams 22 relates to the overall mass of ball 10. Whereas approximately ten to fifteen percent of the mass of a conventional sport ball may be from the seams between panels, welding panels 21 may reduce the mass at seams 22. By eliminating stitched seams in casing 20, the mass that would otherwise be imparted by the stitched seams may be utilized for other structural elements that enhance the performance properties (e.g., energy return, sphericity, mass distribution, durability, aerodynamics) of ball 10. Another advantage relates to manufacturing efficiency. Stitching each of the seams of a conventional sport ball is a relatively time-consuming process, particularly when hand stitching is utilized. By welding panels 21 together at seams 22, the time necessary for forming casing 20 may be deceased, thereby increasing the overall manufacturing efficiency.

Intermediate layer 30 is positioned between casing 20 and bladder 40 and may be formed to include one or more of a compressible foam layer that provides a softened feel to the sport ball, a rubber layer that imparts energy return, and a restriction layer to restrict expansion of bladder 40. The overall structure of intermediate layer 30 may vary significantly. As an example, the restriction layer may be formed from (a) a thread, yarn, or filament that is repeatedly wound around bladder 40 in various directions to form a mesh that covers substantially all of bladder 40, (b) a plurality of generally flat or planar textile elements stitched together to form a structure that extends around bladder 40, (c) a plurality of generally flat or planar textile strips that are impregnated with latex and placed in an overlapping configuration around bladder 40, or (d) a substantially seamless spherically-shaped textile. In some configurations of ball 10, intermediate layer 30 or portions of intermediate layer 30 may also be bonded, joined, or otherwise incorporated into casing 20 as a backing material, or intermediate layer 30 may be absent from ball 10. Accordingly, the structure of intermediate layer 30 may vary significantly to include a variety of configurations and materials.

Bladder 40 has an inflatable configuration and is located within intermediate layer 30 to provide an inner portion of ball 10. When inflated, bladder 40 exhibits a rounded or generally spherical shape. In order to facilitate inflation, bladder 40 may include a valved opening (not depicted) that extends through intermediate layer 30 and casing 20, thereby being accessible from an exterior of ball 10, or bladder 40 may have a valveless structure that is semi-permanently inflated. Bladder 40 may be formed from a rubber or carbon latex material that substantially prevents air or other fluids within bladder 40 from diffusing to the exterior of ball 10. In addition to rubber and carbon latex, a variety of other elastomeric or otherwise stretchable materials may be utilized for bladder 40. Bladder 40 may also have a structure formed from a plurality of joined panels, as disclosed in U.S. patent application Ser. No. 12/147,943, filed in the U.S. Patent and Trademark Office on 27 Jun. 2008, which is entirely incorporated herein by reference.

Figure 4:
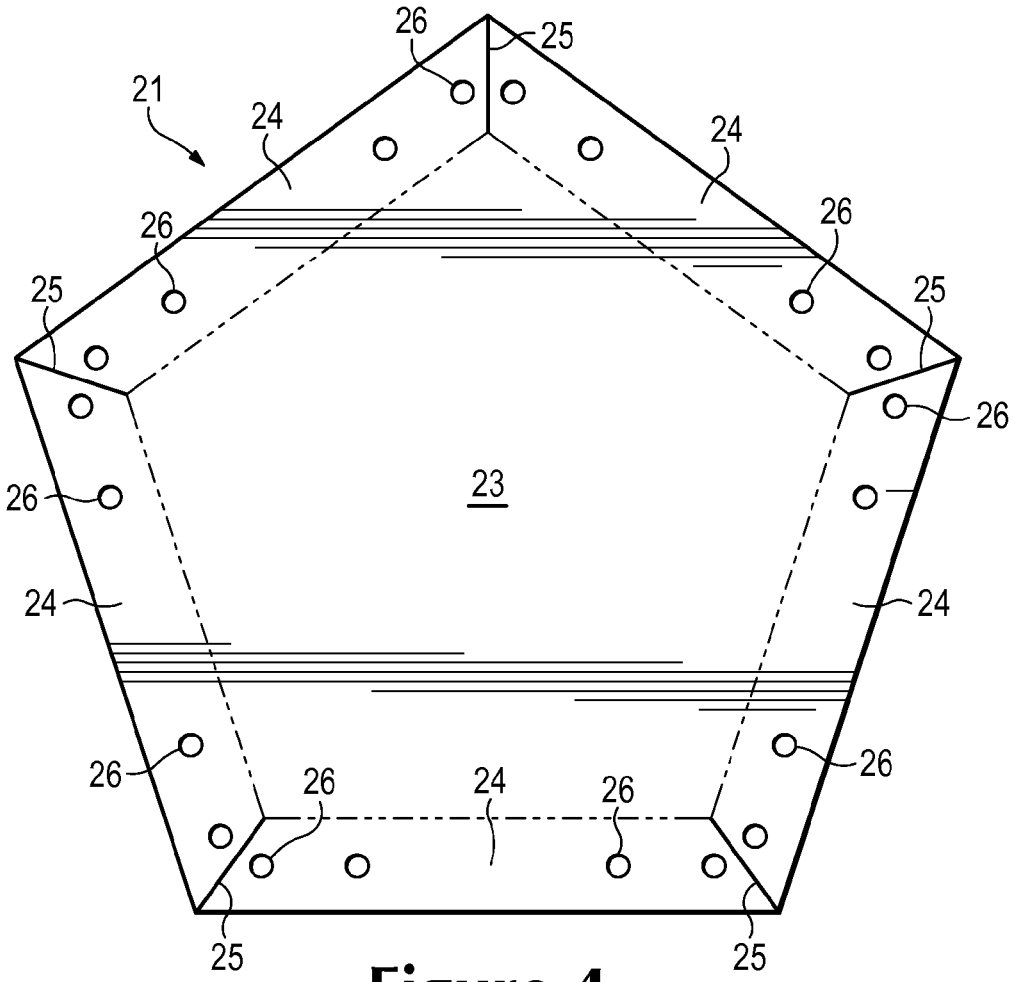
FIG. 4 is a top plan view of a panel of the sport ball.

The panels of conventional sport balls, as discussed above, may be joined with stitching (e.g., hand or machine stitching). Panels 21 are, however, at least partially formed from a polymer material, which may be a thermoplastic polymer material, that can be joined through the welding process. Referring to FIG. 4, one of panels 21 prior to incorporation into ball 10 is depicted as having a panel area 23 and five flange areas 24. Whereas panel area 23 generally form a central portion of panel 21, flange areas 24 form an edge portion of panel 21 and extend around panel area 23. For purposes of reference, dashed lines are depicted as extending between panel area 23 and the various flange areas 24. Panel 21 has a pentagonal shape and each of flange areas 24 correspond with one side region of the pentagonal shape. In further configurations where a panel has a different shape, the number of flange areas may change to correspond with the number of sides of the shape. Panel 21 defines five incisions 25 that extend inward from vertices of the pentagonal shape and effectively separate the various flange areas 24 from each other. Incisions 25 extend entirely through the thickness of panels 21 to disconnect flange areas 25 from each other and permit flange areas 24 to flex or otherwise move independent of each other, although flange areas 24 remain connected to panel area 23. Additionally, each flange area 24 defines various registration apertures 26 that form holes extending through panel 21.

Figure 5:
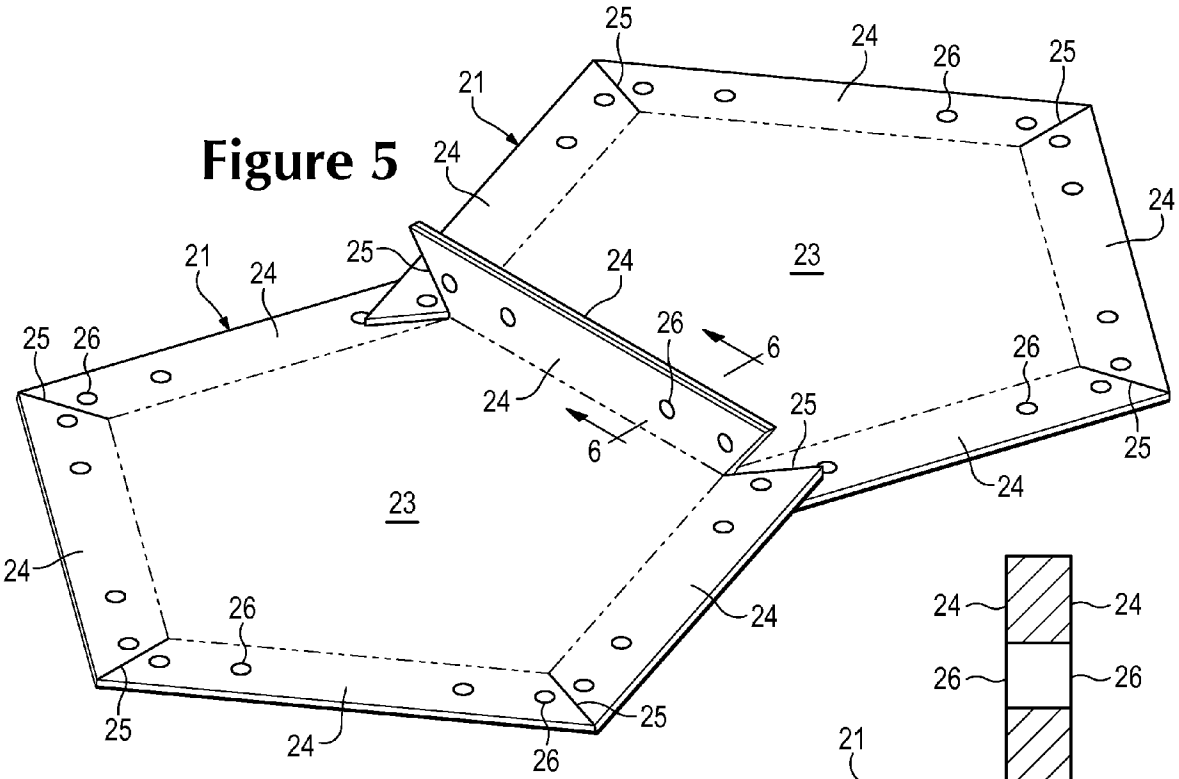
FIG. 5 is a perspective view of two joined panels.
Figure 6:
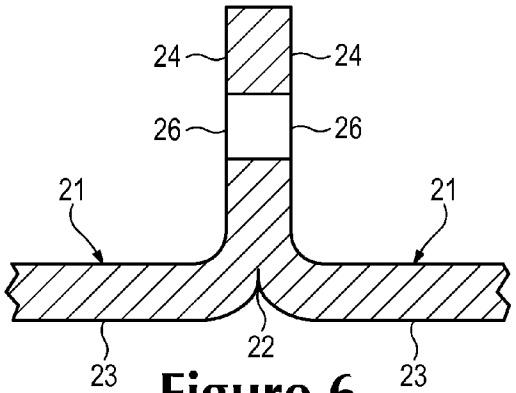
FIG. 6 is a cross-sectional view of the joined panels, as defined by section line 6-6 in FIG. 5.

Panel areas 23 of the various panels 21 form a majority or all of the portion of casing 20 that is visible on the exterior of ball 10. Flange areas 24, however, form portions of panels 21 that are bonded together to join panels 21 to each other. Referring to FIGS. 5 and 6, an example of the manner in which two panels 21 are joined to each other is depicted. Although panel areas 23 are generally co-planar with each other, the joined flange areas 24 bend upward and are joined along abutting surfaces. Additionally, registration apertures 26 from each of the joined flange areas 24 are aligned. By aligning registration apertures 26 prior to bonding (i.e., through welding), flange areas 24 are properly positioned relative to each other. As discussed in greater detail below, portions of the joined flange areas 24 may be trimmed during the manufacturing process for casing 20. Note that the upwardly-facing surfaces in FIGS. 5 and 6 are located on an interior of ball 10 once manufacturing is completed, and downwardly-facing surfaces form an exterior surface of ball 10.

Panels 21 are discussed above as including a polymer material, which may be utilized to secure panels 21 to each other. Examples of suitable polymer materials for panels 21 include thermoplastic and/or thermoset polyurethane, polyamide, polyester, polypropylene, and polyolefin. In some configurations, panels 21 may incorporate filaments or fibers that reinforce or strengthen casing 20. In further configurations, panels 21 may have a layered structure that includes an outer layer of the polymer material and an inner layer formed from a textile, polymer foam, or other material that is bonded with the polymer material.

When exposed to sufficient heat, the polymer materials within panels 21 transition from a solid state to either a softened state or a liquid state, particularly when a thermoplastic polymer material is utilized. When sufficiently cooled, the polymer materials then transition back from the softened state or the liquid state to the solid state. Based upon these properties of polymer materials, welding processes may be utilized to form a weld that joins portions of panels 21 (i.e., flange areas 24) to each other. As utilized herein, the term "welding" or variants thereof is defined as a securing technique between two elements that involves a softening or melting of a polymer material within at least one of the elements such that the materials of the elements are secured to each other when cooled. Similarly, the term "weld" or variants thereof is defined as the bond, link, or structure that joins two elements through a process that involves a softening or melting of a polymer material within at least one of the elements such that the materials of the elements are secured to each other when cooled. As examples, welding may involve (a) the melting or softening of two panels 21 that include polymer materials such that the polymer materials from each panel 21 intermingle with each other (e.g., diffuse across a boundary layer between the polymer materials) and are secured together when cooled and (b) the melting or softening a polymer material in a first panel 21 such that the polymer material extends into or infiltrates the structure of a second panel 21 (e.g., infiltrates crevices or cavities formed in the second panel 21 or extends around or bonds with filaments or fibers in the second panel 21) to secure the panels 21 together when cooled. Welding may occur when only one panel 21 includes a polymer material or when both panels 21 include polymer materials. Additionally, welding does not generally involve the use of stitching or adhesives, but involves directly bonding panels 21 to each other with heat. In some situations, however, stitching or adhesives may be utilized to supplement the weld or the joining of panels 21 through welding.

Figure 7:
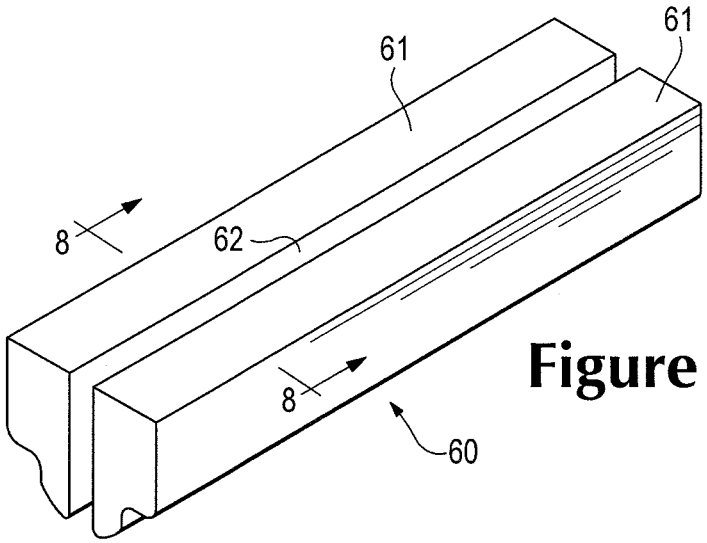
FIG. 7 is a perspective view of a welding tool utilized in joining the panels.
Figure 8:
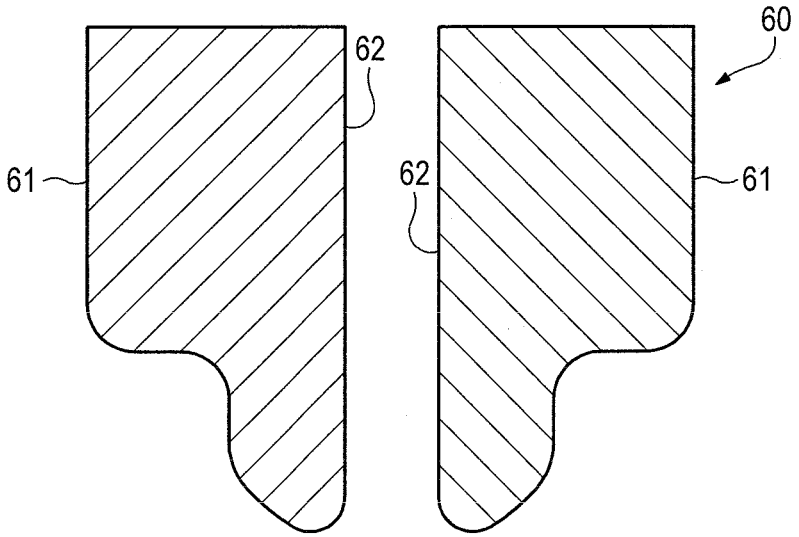
FIG. 8 is a cross-sectional view of the welding tool, as defined by section line 8-8 in FIG. 7.

A variety of techniques may be utilized to weld flange areas 24 to each other, including conduction heating, radiant heating, radio frequency (RF) heating, ultrasonic heating, and laser heating. An example of a welding die 60 that may be utilized to form seams 22 by bonding two flange areas 24 is depicted in FIGS. 7 and 8. Welding die 60 includes two portions 61 that generally correspond in length with a length of one of the sides of panels 21. That is, the length of welding die 60 is generally as long as or longer than the lengths of flange areas 24. Each portion 61 also defines a facing surface 62 that faces the other portion 61. That is, facing surfaces 62 face each other. If utilized for purposes of conduction heating, for example, portions 61 may each include internal heating elements or conduits that channel a heated liquid in order to sufficiently raise the temperature of welding die 60 to form a weld between flange areas 24. If utilized for purposes of radio frequency heating, one or both of portions 61 may emit radio frequency energy that heats the particular polymer material within panels 21. In addition to welding die 60, a variety of other apparatuses that may effectively form a weld between panels 21 may be utilized.

Figure 9A:
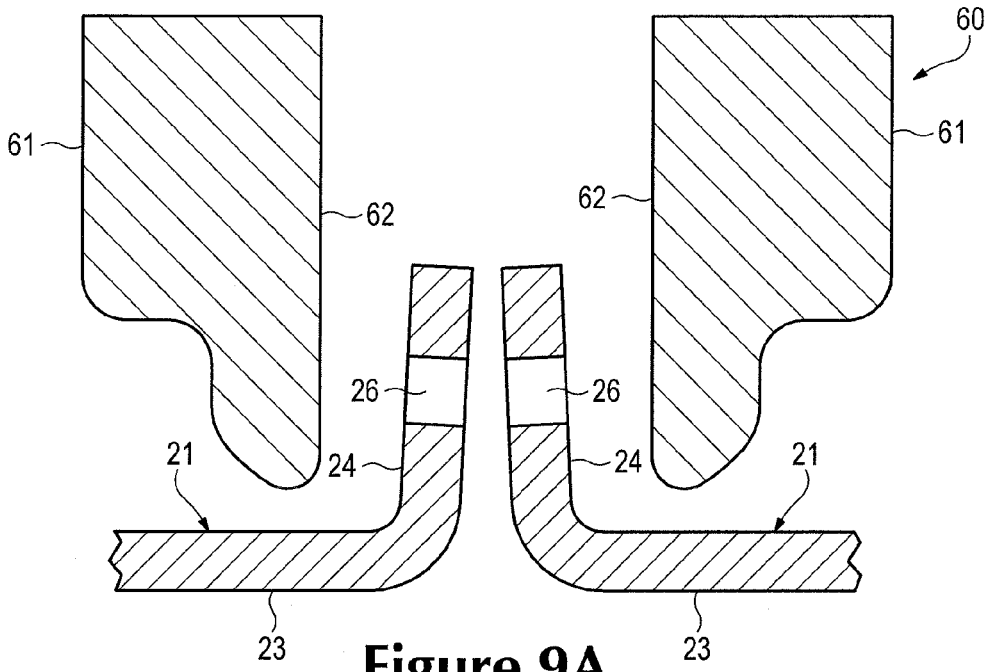
FIGS. 9A-9E are schematic cross-sectional views depicting steps of welding the panels together in a manufacturing process for the sport ball.
Figure 9B:
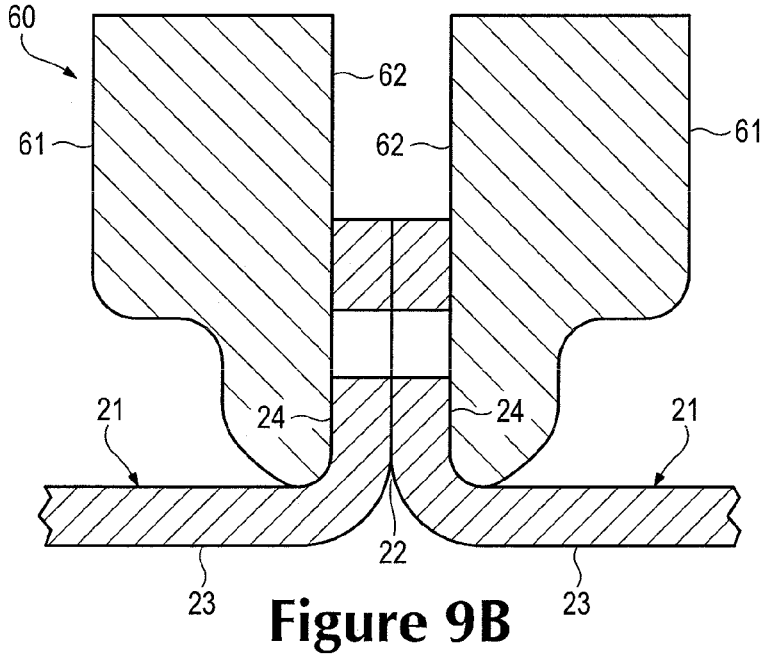
Figure 9C:
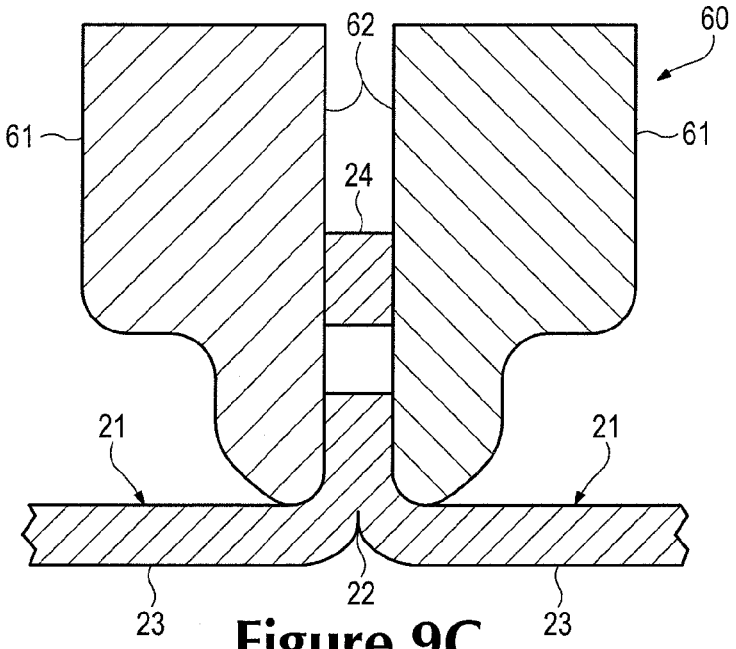
Figure 9D:
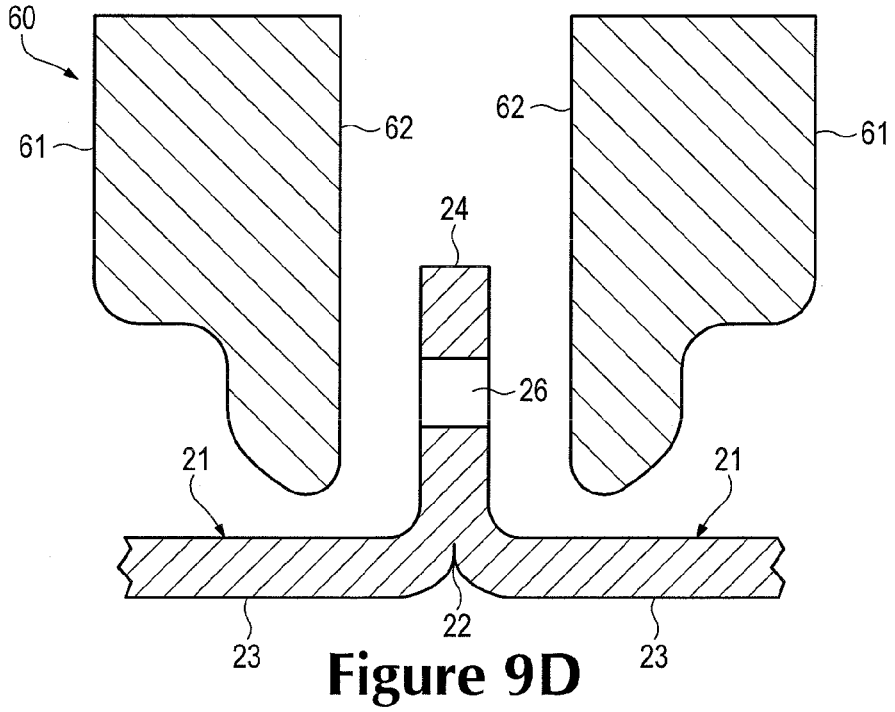
Figure 9E:
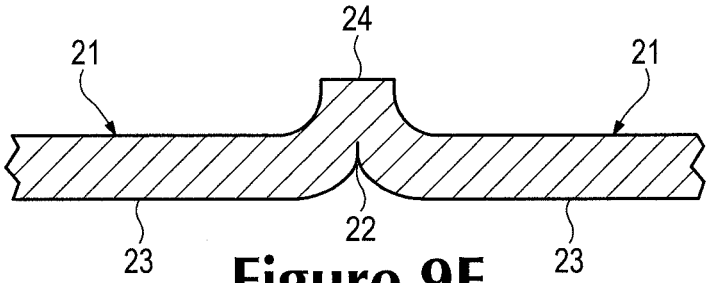

A general process for joining panels 21 with welding die 60 will now be discussed with reference to FIGS. 9A-9E. Initially, adjacent flange areas 24 from two panels 21 are located such that (a) surfaces of the flange areas 24 face each other and (b) registration apertures 26 are generally aligned, as depicted in FIG. 9A. Portions 61 of welding die 60 are also located on opposite sides of the abutting flange areas 24. Portions 61 then compress flange areas 24 together between facing surfaces 62 to cause surfaces of flange areas 24 to contact each other, as depicted in FIG. 9B. By heating flange areas 24 with welding die 60, the polymer materials within flange areas 24 melt or otherwise soften to a degree that facilitates welding between flange areas 24, as depicted in FIG. 9C, thereby forming seam 22 between panels 21. Once seam 22 is formed by bonding flange areas 24 together, portions 61 may retract from flange areas 24, as depicted in FIG. 9D. Excess portions of flange areas 24, which may include portions that define registration apertures 26, are then trimmed or otherwise removed to complete the formation of one of seams 22, as depicted in FIG. 9E.

Figure 10:
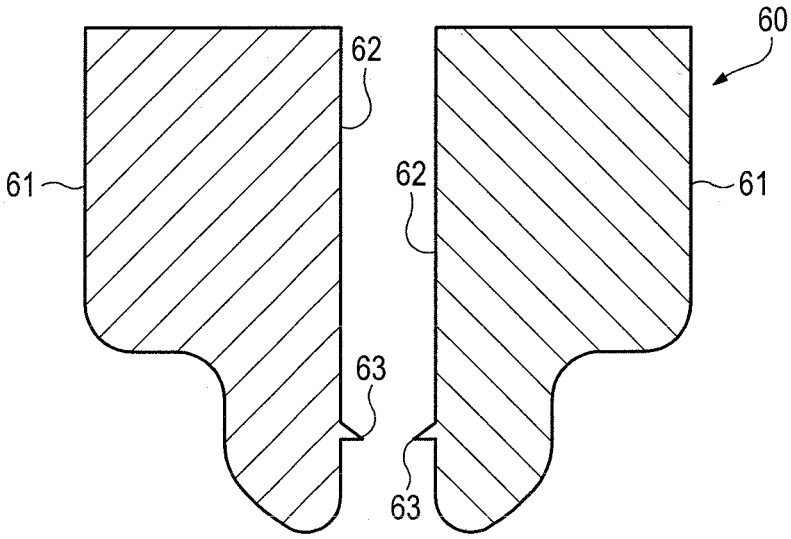
FIG. 10 is a cross-sectional view that corresponds with FIG. 8 and depicts another configuration of the welding tool.

A variety of trimming processes may be utilized to remove the excess portions of flange areas 24. As examples, the trimming processes may include the use of a cutting apparatus, a grinding wheel, or an etching process. As another example, welding die 60 may incorporate cutting edges 63, as depicted in FIG. 10, that trim flange areas 24 during the welding process. That is, cutting edges 63 may be utilized to protrude through flange areas 24 and effectively trim flange areas 24 as portions 61 heat and compress flange areas 24 together between facing surfaces 62.

Figure 11A:
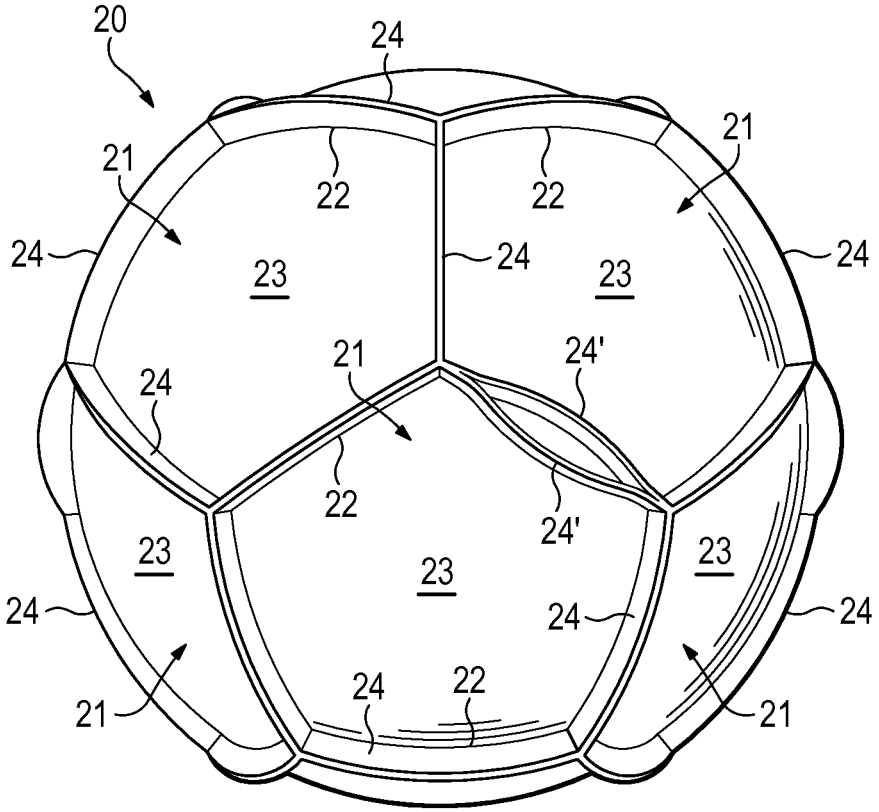
FIGS. 11A-11F are perspective views depicting further steps in the manufacturing process for the sport ball.
Figure 11B:
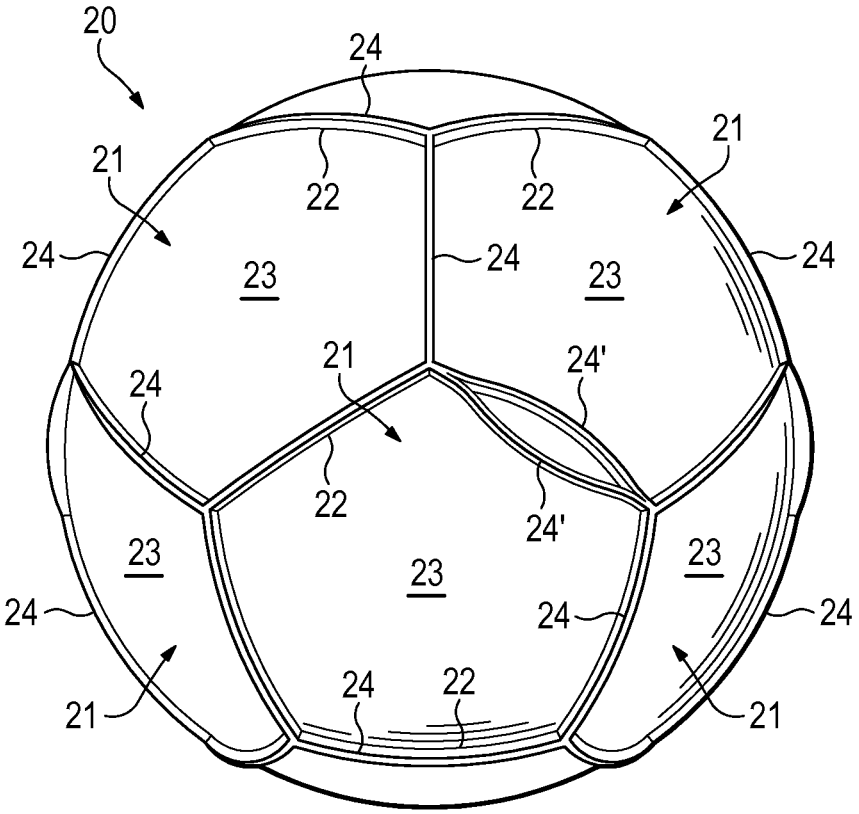

The general process of welding flange areas 24 to form seams 22 between panels 21 was generally discussed above relative to FIGS. 9A-9E. This general process may be repeatedly performed with multiple panels 21 and on multiple flange areas 24 of each panel 21 to effectively form a generally spherical or closed structure, as depicted in FIG. 11A. That is, multiple panels 21 may be welded together through the general process discussed above in order to form various seams 22 in casing 20. A similar configuration is depicted in FIG. 11B, wherein flange areas 24 are trimmed. As discussed above, the trimming or removal of flange areas 24 may occur following the welding process or may occur at the time of the welding process.

Figure 11C:
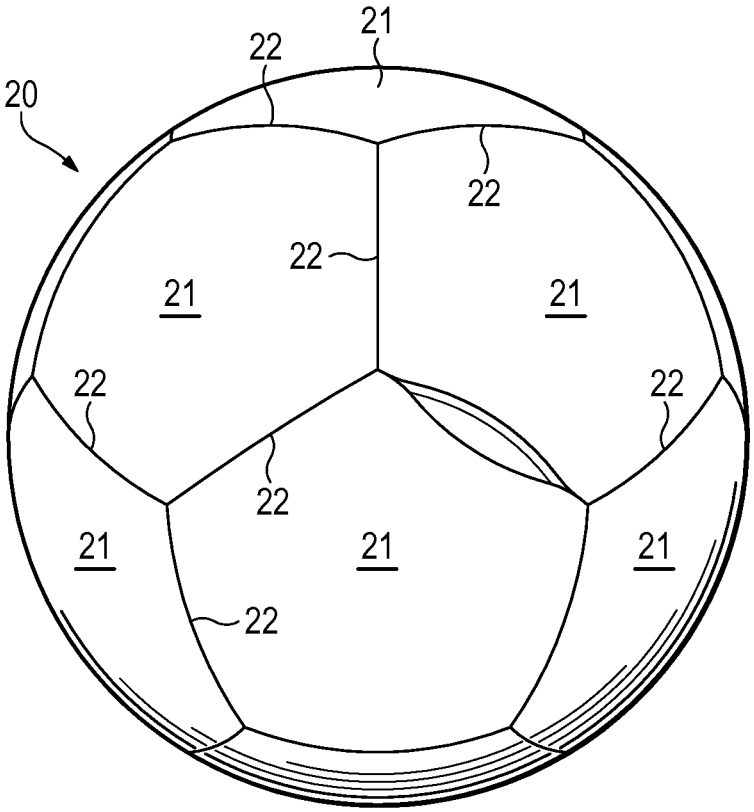

Although seams 22 are generally formed between each of flange areas 24, at least two flange areas 24 may remain unbonded to each other at this stage of the manufacturing process. Referring to FIGS. 11A and 11B, unbonded flange areas 24 are identified with reference numeral 24'. One purpose of leaving at least two flange areas 24 unbonded to each other is that casing 20 may be turned inside-out through an opening formed between the unbonded flanges 24. More particularly, the unbonded flanges 24 may be separated to form an opening, as depicted in FIG. 11B, and casing 20 may be reversed or turned inside-out through that opening to impart the configuration depicted in FIG. 11C. Whereas the trimmed portions of flange areas 24 protrude outward in FIG. 11B, reversing or turning casing 20 inside-out through the opening between unbonded flange areas 24 places all of flange areas 24 within casing 20. Accordingly, the trimmed flange areas 24 protrude inward, rather than outward once casing 20 is reversed or turned inside-out. Referring to FIG. 3, for example, an exterior of casing 20 has a generally smooth configuration, while portions of casing 20 corresponding with flange areas 24 protrude inward. Although panels 21 form an indentation on the exterior of ball 10 in the areas of seams 22, similar indentations are commonly found in game balls with stitched seams.

Figure 11D:
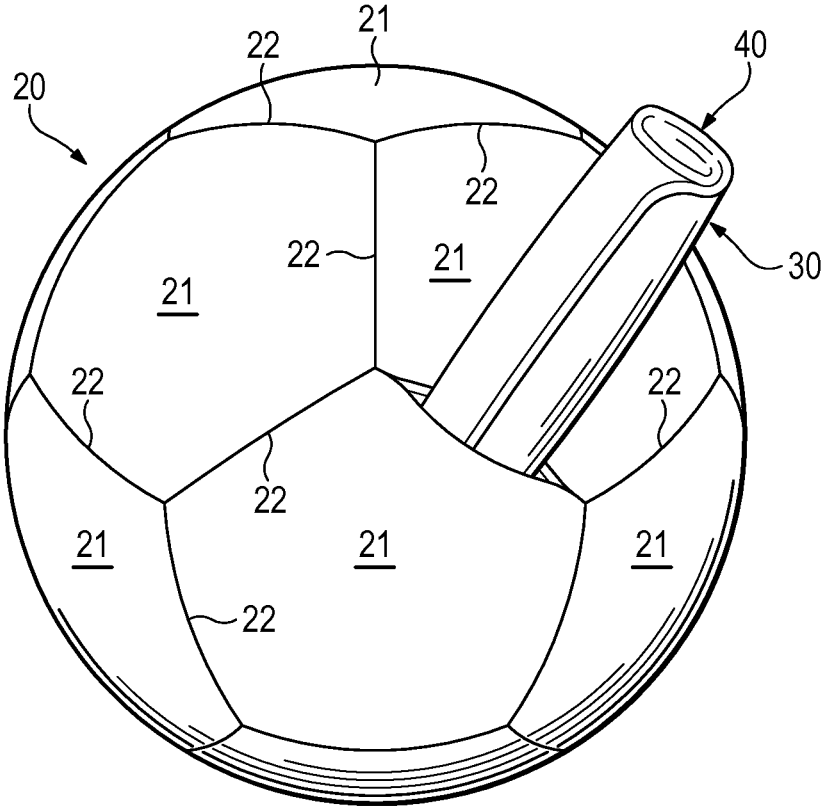
Figure 11E:
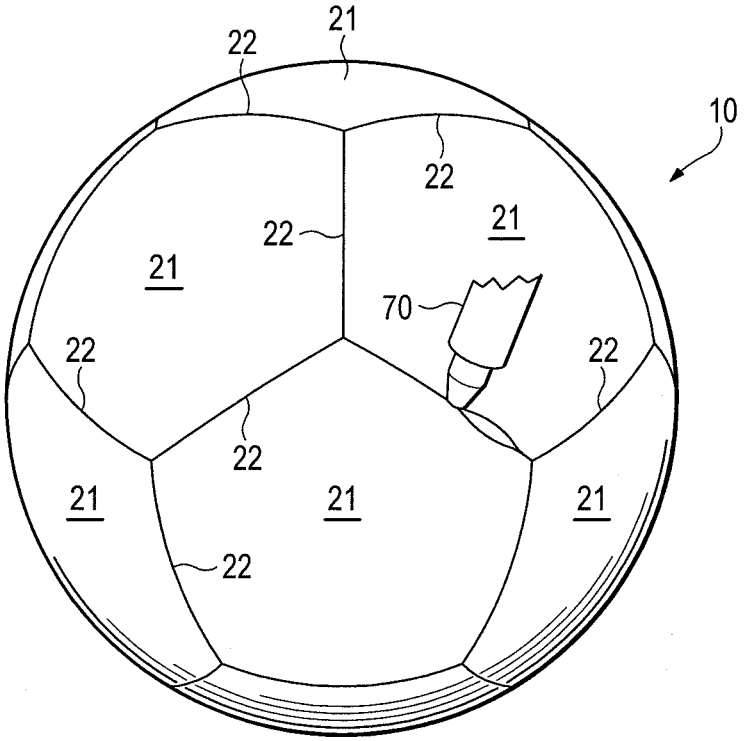
Figure 11F:
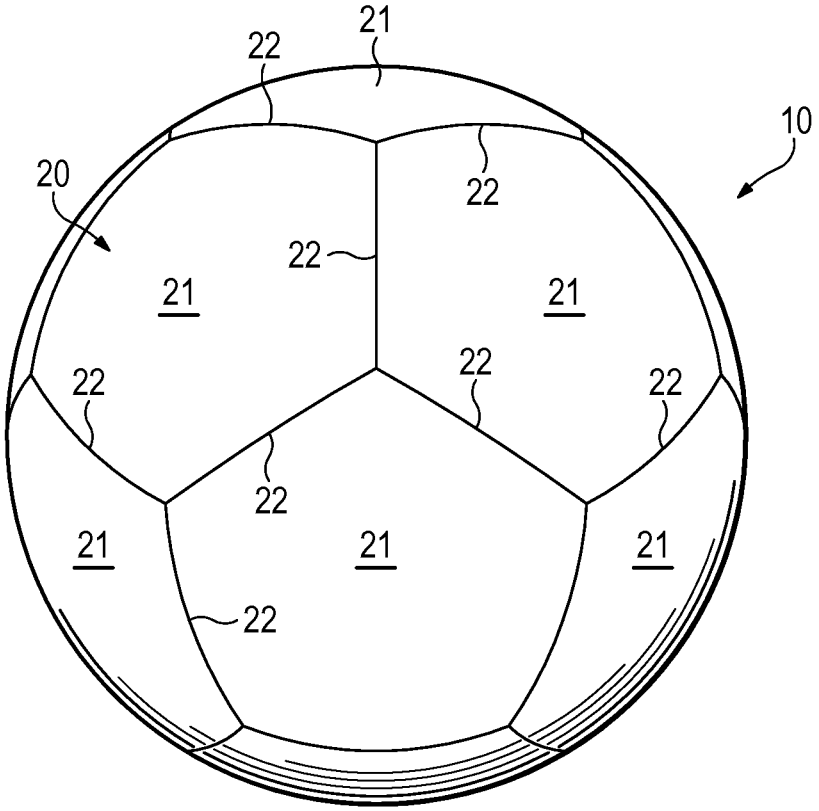

At this stage of the manufacturing process, casing 20 is substantially formed and the surfaces of casing 20 are correctly oriented. The opening in casing 20 formed between unbonded flange areas 24 may now be utilized to insert intermediate layer 30 and bladder 40, as depicted in FIG. 11D. That is, intermediate layer 30 and bladder 40 may be located within casing 20 through the opening that was utilized to reverse or turn casing 20 inside-out. Intermediate layer 30 and bladder 40 are then properly positioned within casing 20, which may include partially inflating bladder 40 to induce contact between surfaces of intermediate layer 30 and casing 20. Additionally, the valved opening (not depicted) of bladder 40 may be located to extend through intermediate layer 30 and casing 20, thereby being accessible from an exterior of ball 10. Once intermediate layer 30 and bladder 40 are properly positioned within casing 20, the opening in casing 20 formed between unbonded flange areas 24 may be sealed, as depicted in FIG. 11E. More particularly, a sealing die 70 may form a weld between the unbonded flange areas 24 to form a final seam 22 that effectively closes casing 20, thereby substantially completing the manufacturing process of ball 10, as depicted in FIG. 11F. As an alternative to welding, stitching or adhesives may be utilized to close casing 20.

Figure 12:
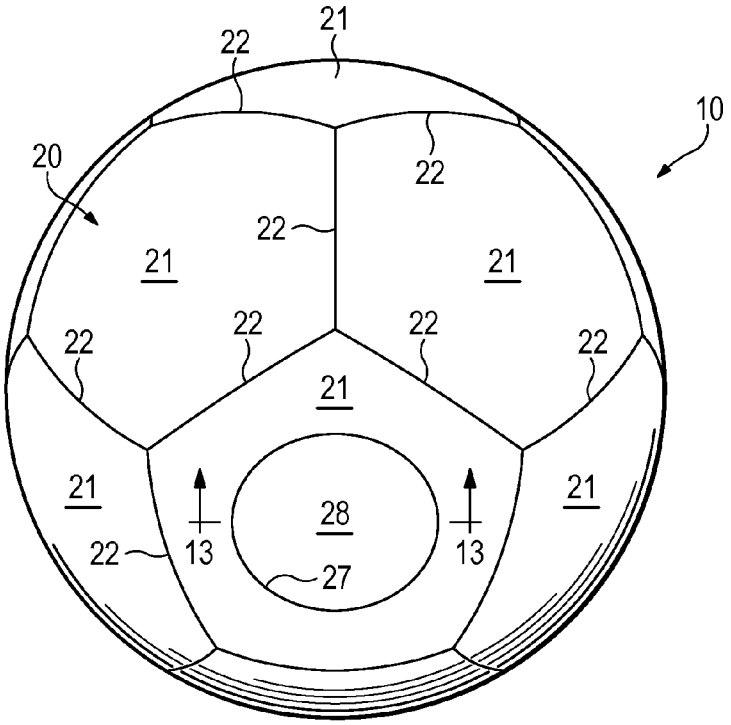
FIG. 12 is a perspective view of another configuration of the sport ball.
Figure 13:
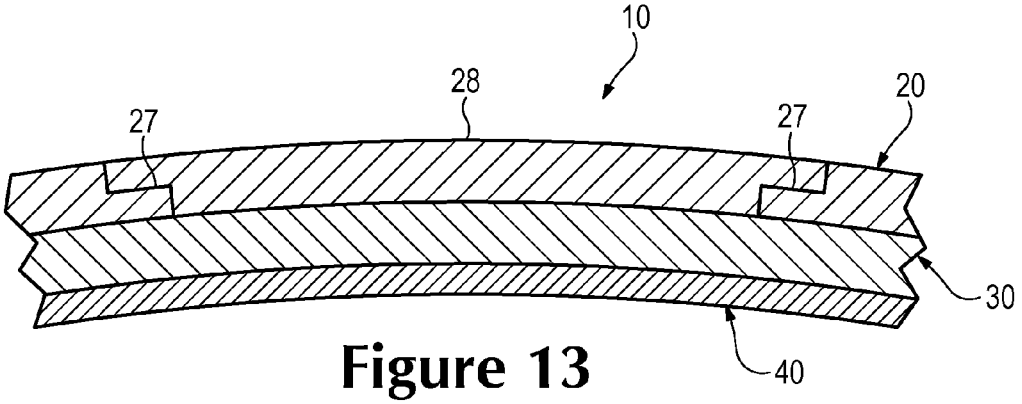
FIG. 13 is a cross-sectional view of a portion of the sport ball depicted in FIG. 12, as defined by section line 13-13 in FIG. 12.
Figure 14A:
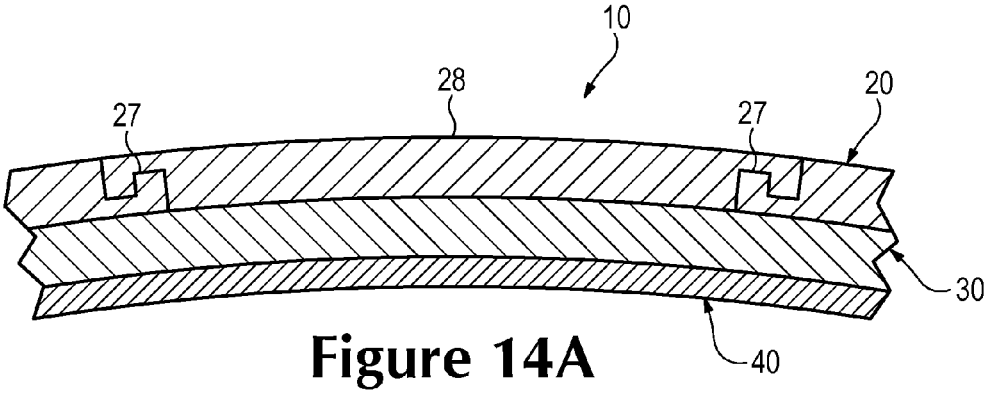
FIGS. 14A-14E are cross-sectional views that correspond with FIG. 13 and depict further configurations.
Figure 14B:
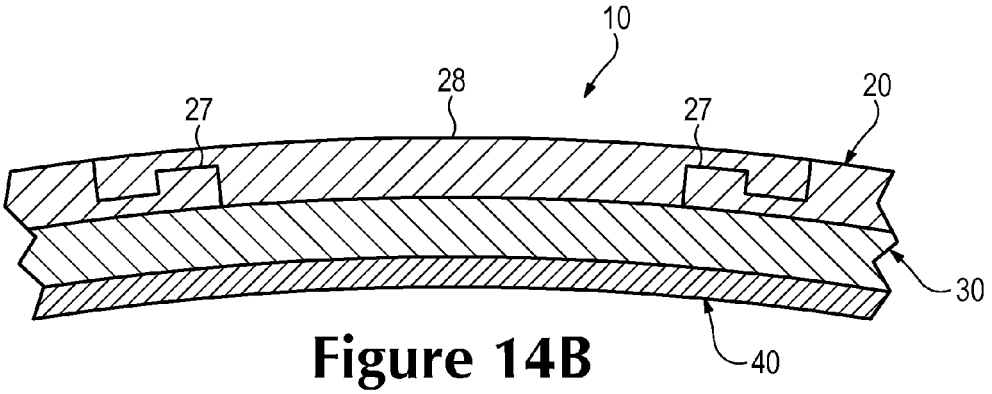
Figure 14C:
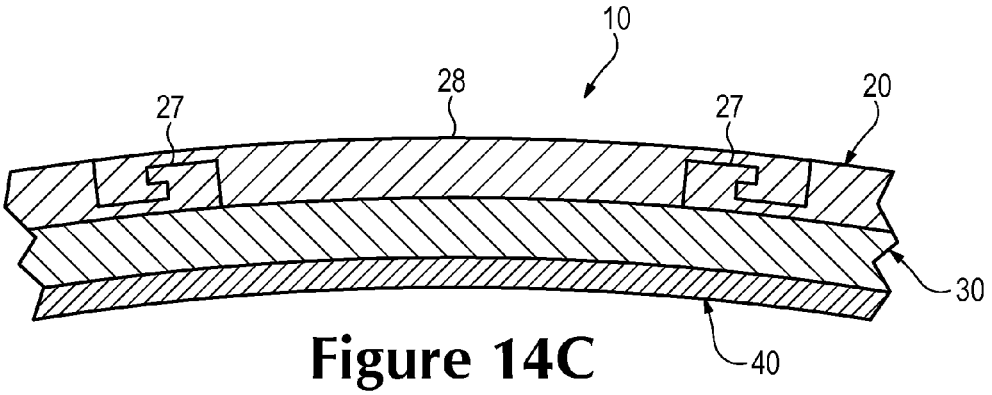
Figure 14D:
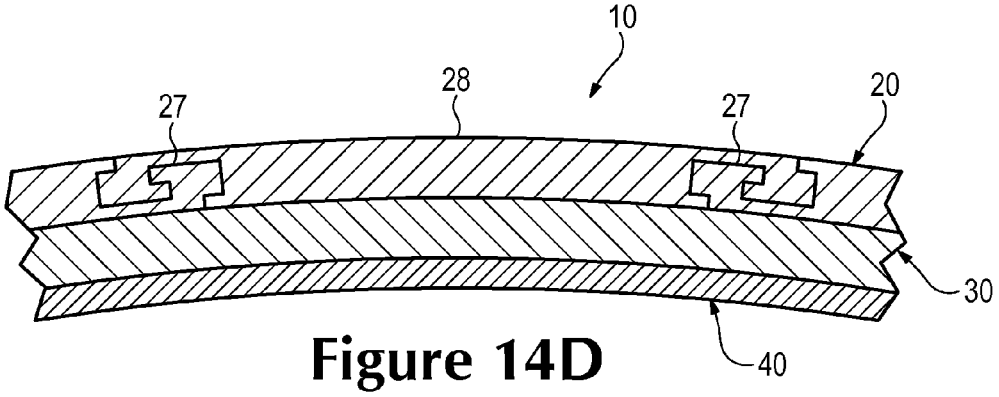
Figure 14E:
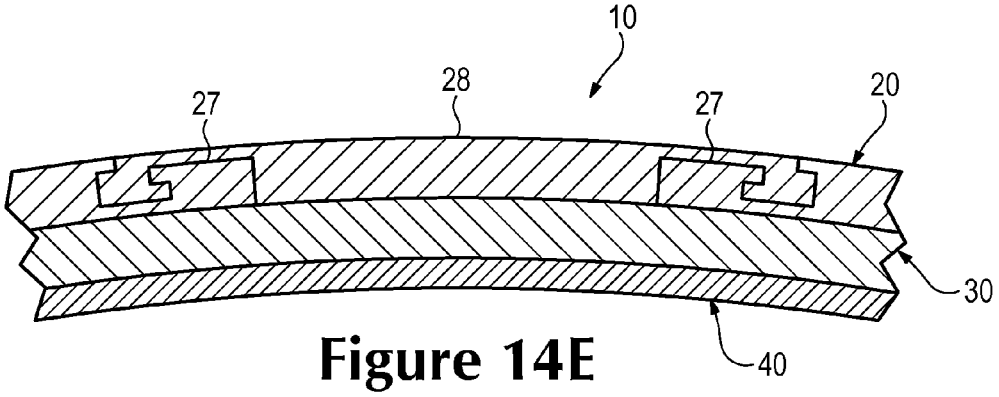

An opening in casing 20 formed between unbonded flange areas 24 is one example of a structure that may be utilized to (a) reverse or turn casing 20 inside-out to place protruding flange areas 24 within casing 20 and (b) insert intermediate layer 30 and bladder 40 within casing 20. As another example, one of panels 21 may define an aperture 27 that is sealed with a plug 28, as depicted in FIGS. 12 and 13. More particularly, aperture 27 may be utilized to (a) reverse or turn casing 20 inside-out to place protruding flange areas 24 within casing 20 and (b) insert intermediate layer 30 and bladder 40 within casing 20. Once these steps are complete, plug 28 is located within aperture 27 and welded or otherwise joined to the panel 21 defining aperture 27. Although sealing die 40 or a similar apparatus may be utilized to bond plug 28 to casing 20, stitching or adhesives may also be utilized to close casing 20. Referring to FIG. 13, both the sides of aperture 27 and plug 28 have corresponding stepped configurations that mate and join in a relatively smooth manner. A variety of other configurations may also be utilized, as depicted in the cross-sectional views of FIG. 14A-14E, to impart greater strength or otherwise enhance the bond between aperture 27 and plug 28.

Based upon the above discussion, casing 20 may be at least partially formed by joining panels 21 through a welding process. In comparison with other methods of joining panels, the welding process may reduce the overall mass of ball 10 and increase manufacturing efficiency. Once the welding process is utilized to join panels 21, an opening in casing 20 may be utilized to reverse or turn casing inside-out to place protruding areas within ball 10, thereby forming a substantially smooth exterior surface. Additionally, intermediate layer 30 and bladder 40 may be inserted through the opening in casing 20, which is subsequently sealed.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. A sport ball comprising:

a casing including a plurality of panel elements, wherein two of the plurality of panel elements are joined to each other with a weld to form a seam disposed between the two of the plurality of panel elements;

wherein each of the plurality of panel elements includes:

a central panel area; and a plurality of flange portions each extending from the central panel area and each disposed between another two of the plurality of flange portions, wherein adjacent ones of the plurality of flange portions define an incision therebetween such that each of the plurality of flange portions is disconnected from and flexible with respect to one another;

a bladder defining an interior and configured to contain a pressurized gas; and an intermediate layer disposed between the casing and the bladder;

wherein the intermediate layer abuts the casing, contacts and covers substantially all of the bladder, and extends continuously across the seam, and further wherein the intermediate layer has a limited degree of stretch and is configured to restrain an outward force applied by the pressurized gas against the bladder;

wherein, when the sport ball is inflated, each of the plurality of flange portions abuts the intermediate layer and deflects the intermediate layer toward the interior; and wherein the intermediate layer is substantially seamless.

2. The sport ball recited in claim 1, wherein the casing forms an exterior portion of the sport ball and defines an indentation between adjacent ones of the plurality of panel elements.

3. The sport ball recited in claim 1, wherein each of the plurality of flange portions has an interior surface and an exterior surface disposed opposite the interior surface, and further wherein the exterior surface of one of the plurality of flange portions is welded to the exterior surface of another one of the plurality of flange portions.

4. The sport ball recited in claim 1, wherein each of the plurality of panel elements has a pentagonal shape.

5. The sport ball recited in claim 1, wherein each of the plurality of panel elements is formed from a thermoplastic polymer material.

6. The sport ball recited in claim 1, wherein each of the plurality of panel elements is formed from a thermoplastic polyurethane material.

7. The sport ball recited in claim 1, wherein the intermediate layer is substantially spherical.

8. The sport ball recited in claim 1, wherein the intermediate layer is formed of a textile.

9. A sport ball comprising:

a casing including a plurality of panel elements, wherein two of the plurality of panel elements are joined to each other with a weld to form a seam disposed between the two of the plurality of panel elements;

wherein each of the plurality of panel elements includes:

a central panel area; and a plurality of flange portions each extending from the central panel area and each disposed between another two of the plurality of flange portions, wherein adjacent ones of the plurality of flange portions define an incision therebetween such that each of the plurality of flange portions is disconnected from and flexible with respect to one another;

a bladder defining an interior and configured to contain a pressurized gas; and an intermediate layer disposed between the casing and the bladder;

wherein the intermediate layer abuts the casing, contacts and covers substantially all of the bladder, and extends continuously across the seam, and further wherein the intermediate layer has a limited degree of stretch and is configured to restrain an outward force applied by the pressurized gas against the bladder;

wherein, when the sport ball is inflated, each of the plurality of flange portions projects toward the interior, abuts the intermediate layer, and deflects the intermediate layer toward the interior; and wherein the intermediate layer is a substantially seamless, spherically-shaped textile.

10. The sport ball recited in claim 9, wherein the casing is formed at least in part from a thermoplastic polymer material.

11. The sport ball recited in claim 10, wherein the thermoplastic polymer material is a thermoplastic polyurethane material.

12. The sport ball recited in claim 9, wherein the casing forms an exterior portion of the sport ball and defines an indentation between adjacent ones of the plurality of panel elements.

13. The sport ball recited in claim 9, wherein each of the plurality of flange portions has an interior surface and an exterior surface disposed opposite the interior surface, and further wherein the exterior surface of one of the plurality of flange portions is welded to the exterior surface of another one of the plurality of flange portions.

14. The sport ball recited in claim 9, wherein each of the plurality of flange portions defines a plurality of apertures therein that are configured for aligning one of the plurality of flange portions with an adjacent one of the plurality of flange portions.

15. A sport ball comprising:

a casing including a plurality of panel elements, wherein two of the plurality of panel elements are joined to each other with a weld to form a seam disposed between the two of the plurality of panel elements;

wherein each of the plurality of panel elements includes:

a central panel area; and a plurality of flange portions each extending from the central panel area and each disposed between another two of the plurality of flange portions, wherein adjacent ones of the plurality of flange portions define an incision therebetween such that each of the plurality of flange portions is disconnected from and flexible with respect to one another;

a bladder defining an interior and configured to contain a pressurized gas; and an intermediate layer disposed between the casing and the bladder;

wherein the intermediate layer abuts the casing, contacts and covers substantially all of the bladder, and extends continuously across the seam, and further wherein the intermediate layer has a limited degree of stretch and is configured to restrain an outward force applied by the pressurized gas against the bladder;

wherein each of the plurality of panel elements has a layered structure that includes an outer layer formed from a polymer material and an inner layer formed from a textile; and wherein the intermediate layer is a substantially seamless, spherically-shaped textile;

wherein, when the sport ball is inflated, each of the plurality of flange portions projects toward the interior, abuts the intermediate layer, and deflects the intermediate layer toward the interior.

16. The sport ball recited in claim 15, wherein each of the plurality of flange portions has an interior surface and an exterior surface disposed opposite the interior surface, and further wherein the exterior surface of one of the plurality of flange portions is welded to the exterior surface of another one of the plurality of flange portions.

17. The sport ball recited in claim 15, wherein each of the plurality of flange portions defines a plurality of apertures therein that are configured for aligning one of the plurality of flange portions with an adjacent one of the plurality of flange portions.

18. The sport ball recited in claim 15, wherein the polymer material is a thermoplastic polymer.

19. The sport ball recited in claim 18, wherein the thermoplastic polymer is selected from the group including thermoplastic polyurethane, polyamide, polyester, polypropylene, and polyolefin.

* * * * *